United States Patent [19]

Butt

[11] 4,133,253

[45] Jan. 9, 1979

[54] PARTITION POSITIONER

[75] Inventor: William C. Butt, Lynchburg, Va.

[73] Assignee: Simplimatic Engineering Company, Lynchburg, Va.

[21] Appl. No.: 856,612

[22] Filed: Dec. 2, 1977

[51] Int. Cl.[2] ..... B31D 3/04

[52] U.S. Cl. ..... 93/37 R; 93/36 R

[58] Field of Search ..... 93/37 R, 37 EC, 37 SP, 93/36 R; 53/248, 262, 263

[56] References Cited

U.S. PATENT DOCUMENTS

| | | | |
|---|---|---|---|
| 2,024,201 | 12/1935 | Benoit et al. | 93/37 R |
| 2,540,743 | 2/1951 | Leach | 53/248 X |
| 3,788,034 | 1/1974 | Hartness et al. | 53/262 X |
| 3,803,993 | 4/1974 | Graham | 93/37 R X |
| 4,034,656 | 7/1977 | Raudat et al. | 53/263 X |

*Primary Examiner*—James F. Coan
*Attorney, Agent, or Firm*—James & Franklin

[57] ABSTRACT

Apparatus for positioning partitions in a container to form compartments to receive articles comprises first and second assemblies, each of the assemblies comprising a support and a plurality of mandrels secured to the support, extending generally from the support in a given direction towards the container bottom, and terminating in heads adapted to align and straighten the partitions in the container to form compartments for the receipt of articles. A drive mechanism moves one of the assemblies in said given direction toward and away from the container bottom, and the first and second assemblies are secured together in a manner enabling at least limited relative motion therebetween in said given direction. The mandrels of the first assembly preferably are disposed inwardly of the mandrels of the second assembly in the thus-produced mandrel pattern, and the first assembly mandrel heads normally extend further towards the container bottom than the second assembly mandrel heads.

18 Claims, 8 Drawing Figures

FIG. 7
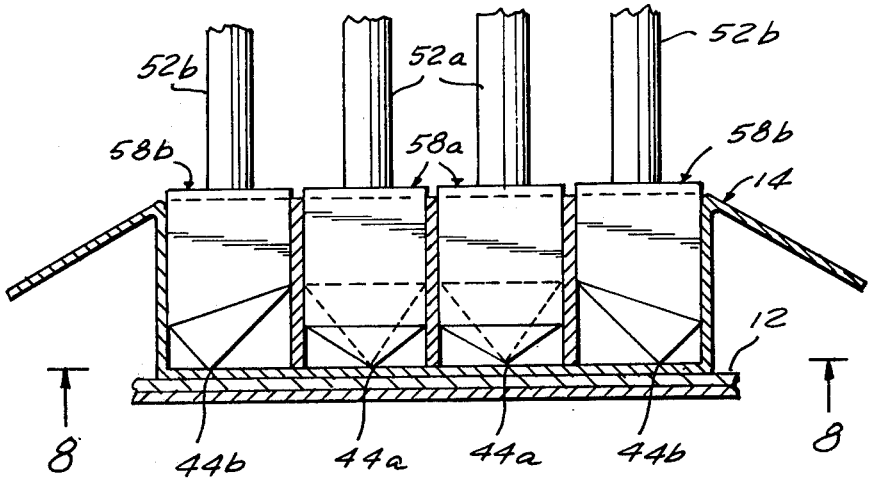
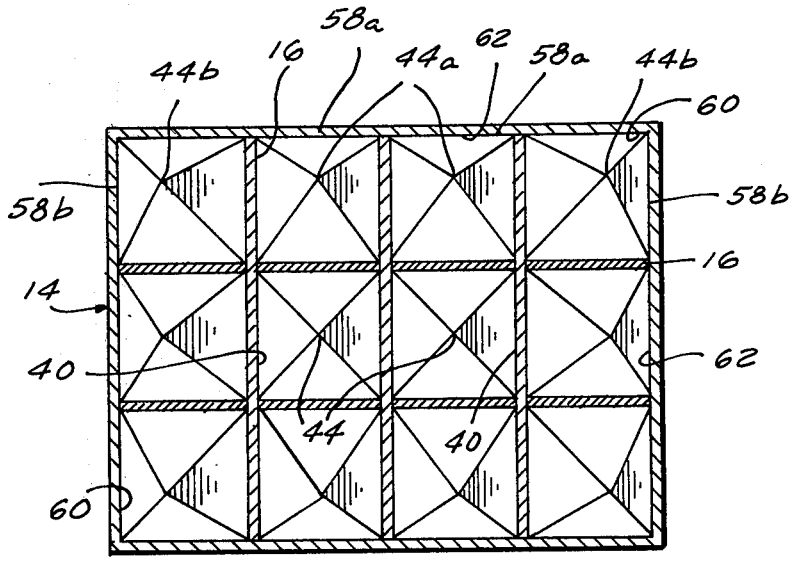
FIG. 8

PARTITION POSITIONER

BACKGROUND OF THE INVENTION

The present invention relates to apparatus for positioning partitions in a container, and more particularly to apparatus adapted to align and straighten the partitions in the container to form compartments to receive articles.

Where a plurality of articles (for example, glass bottles) are to be arranged in containers in a plurality of parallel rows, it is frequently desired to place a protective medium between the individual containers so they will better withstand shipment in the container. Containers to be thus packed are first provided with partitioning devices which divide the interior of the container into a plurality of open-top cells or compartments, each adapted to receive a single article, thereby to protect the article from contact with other articles. The partitioning device commonly employed for the purpose of forming the compartments comprises two sets of parallel strips of corrugated board or other material, the strips of each set being arranged in parallel spaced relation and held in such relation by means of interengaging notches or slits extending approximately half the width of the strips. As the placement of the partitions in the container must be done rather quickly in an automated packing process and as the corrugated board strips are both flexible and, to a certain degree, resilient, it frequently happens that the partitions forming the article compartments are not in proper place to receive the articles. Even where the partitions are initially placed into the container correctly, during the conveyance of the container from the partition-inserting station to the packing station, the partitions often become misaligned and require straightening prior to packing. Otherwise, as the articles are being inserted through the misaligned partition into the partially closed compartments, they are apt to jam against the edges of the partitions and be prevented from entering their respective compartments. A partition positioning device is frequently used for automatically positioning the yielding partitions (i.e., the walls of the compartments) so that the partitions are aligned and straightened, the compartments are fully open and there will be no jamming of the articles as the charge of articles is placed in the container.

In unstraightened partition containers, even though the partitions are disarranged in random fashion, there still exist target areas, that is, areas contained within the unstraightened partitions that are contained by the partitions when straightened. These target areas have been found to be consistently larger for the centermost partitions, thereby making them the easiest to properly position. Once the central compartments are properly positioned, the remaining target areas increase in size, thereby facilitating their proper positioning.

One way of utilizing this inner-first, outer-last partitioning positioning concept is the utilization of a positioner in which the inner mandrels are longer than the outer mandrels so that the points of the inner mandrels contact the container bottom before the points of the outer mandrels reached the level of the top of the partition. Once the inner mandrels reach the carton bottom, the outer mandrels descend no further. While this is an acceptable arrangement with tall cases, as a full depth plunge of the outer mandrels usually accomplishes no more than a partial plunge, it is unacceptable or less acceptable with respect to short containers wherein the container bottom would terminate descent of both the inner and outer mandrels before the outer mandrels descended sufficiently into the outer compartments to properly position the partitions thereabout.

Another way of utilizing the inner-first, outer-last partition positioning concept is to utilize two separate mandrel assemblies and separate motive means for positioning each within the container. Motive means for the center or inner mandrels is first actuated to cause the inner mandrels to enter and begin straightening the center compartment partitions, thereby increasing the target areas of the outer compartments. At this point the motive means for the outer mandrels is also actuated and both inner and outer mandrels continue to descend towards the container bottom until the inner mandrels reach the container bottom, at which point the motive means for the inner mandrels is deactuated. The motive means for the outer mandrels continues to be actuated until the outer mandrels also reach the container bottom, at which point both inner and outer mandrels are removed to leave the container containing the straightening partitions. The disadvantage of this procedure is that separate motive means must be provided for the inner mandrel set and the outer mandrel set.

Accordingly, it is an object of the present invention to provide a partition positioner which is suitable for use with both short and tall containers.

It is another object to provide such a partition positioner in which a single motive means is used for moving both the inner and outer mandrel sets into the container.

It is a further object to provide such a partition positioner which is compact, sturdy, simple and inexpensive to manufacture and use.

SUMMARY OF THE INVENTION

It has now been found that the above and related objects of the present invention are obtained in apparatus for positioning partitions in a container to form compartments to receive articles comprising an outer mandrel assembly and an inner mandrel assembly, the inner mandrel assembly being adapted to float relative to the outer mandrel assembly after the inner mandrel assembly heads have contacted the container bottom. The long floating inner mandrel set engages the center partitions first, thereby straightening or properly positioning the center partitions and increasing the target area of the outer partitions. The shorter outer mandrels then engage the outer partitions. After both mandrel sets contact the container bottom, both sets are raised to permit removal of the container with properly positioned partitions.

More particularly the positioning apparatus comprises first and second assemblies, each of the assemblies comprising support means and at least one mandrel. The mandrel or mandrels of each assembly are secured to the support means of the assembly, extend therefrom in a given direction towards the container bottom, and terminate in heads adapted to align and straighten the partitions in the container to form compartments for the receipt of articles. Means are also provided for securing the first and second assemblies together in a manner permitting at least limited relative motion therebetween between first and second relative positions. The mandrels collectively are arranged in a pattern related to (and preferably corresponding to) a desired compartment pattern in the container. When the assemblies are in the first relative position, the mandrels of the first assembly extend in the given direction for a given distance beyond the mandrels of the second assembly, while movement of the assemblies to the second relative position results in a lessening of the given distance (that is, when the assemblies are in the second relative position, the first assembly mandrels extend in the given direction a lesser distance beyond the second assembly mandrels). The mandrels of the first assembly are preferably located more centrally of the pattern (formed by the mandrels) than are the mandrels of the second assembly, and the first assembly mandrel heads normally extend further toward the container bottom than the second assembly mandrel heads. Means are further provided for moving the first and second assemblies in the given direction and permitting the aforesaid relative motion therebetween.

In a preferred embodiment, the securing means permits at least limited relative motion along the transverse axis between the second assembly support means and the first assembly support means. The securing means enables movement of the second assembly along the transverse axis to a point at which the second assembly mandrel heads are displaced to the same level as the first assembly mandrel heads, the first and second assembly mandrel heads being at this same level only when the heads of both mandrel sets are in contact with the container bottom. The securing means causes the first assembly mandrel heads to contact the partition prior to the second assembly mandrel heads, while enabling the second assembly mandrel heads to engage the container bottom upon continued actuation of the moving means after the first assembly mandel heads have engaged the container bottom. At least some of the securing means preferably includes guide rods depending from the first assembly support means and slidably received in the second assembly mandrels to maintain parallel the first and second assembly support means.

The moving means is adapted to move the second assembly heads between a point where the second assembly mandrel heads contact the container bottom and a point where the first and second assembly mandrel heads are withdrawn from the container. The moving means preferably operates directly on the second assembly to move the second assembly along the transverse axis.

Preferably in at least one of the assemblies the mandrels associated therewith are mounted on the support means adjustably in a direction substantially at right angles to the given direction. The first assembly support means is preferably disposed above and normally supported by the second assembly support means.

Preferably the first and second assembly mandrel heads have points at the bottom thereof, the first assembly head points being aligned with the centers of the compartments to be formed by the partitions after alignment and straightening thereof and at least some of the second assembly head points being offset from the centers of the compartments to be formed by the partitions after alignment and straightening thereof in the direction of the walls of the container. Generally each of the first assembly mandrel heads terminates in a point centered relative to the first assembly mandrel head while at least some of the second assembly mandrel heads terminate in points off-center relative to the second assembly mandrel heads.

The apparatus may additionally include limit switch means operatively disposed on the surface of the container bottom opposite that contacted by the mandrel heads to detect and respond to the presence of a misplaced flap of the container by terminating movement of at least one of the assemblies in the given direction.

In another aspect of the present invention, the positioning apparatus comprises first and second support means, and first and second sets of mandrel secured to the first and second support means, respectively, and extending therefrom in a given direction. Means are provided for operably connecting the first support means and the second support means for limited relative motion therebetween, between an initial position wherein the first mandrel set extends further in a given direction towards the bottom of the container than the second mandrel set and a second position wherein both the mandrel sets extend substantially equal distances in the given direction. Means are provided for moving the second support means towards the container bottom such that the first mandrel set engages the partition with the support means in the initial position, and thereafter, the second mandrel set engages the partition. The support connecting means enables the support means to assume the second position after the first mandrel set engages the container bottom and the moving means continues to move the second support means towards the container bottom.

BRIEF DESCRIPTION OF THE DRAWING

FIG. 7 is a fragmentary side elevation view, partially in cross-section, similar to FIG. 5, but taken along the line 7—7 of FIG. 1; and FIG. 8 is a top plan view, partially in cross-section, taken along the line 8—8 of FIG. 7.

DETAILED DESCRIPTION OF THE PREFERRED EMBODIMENTS

Figure 1:
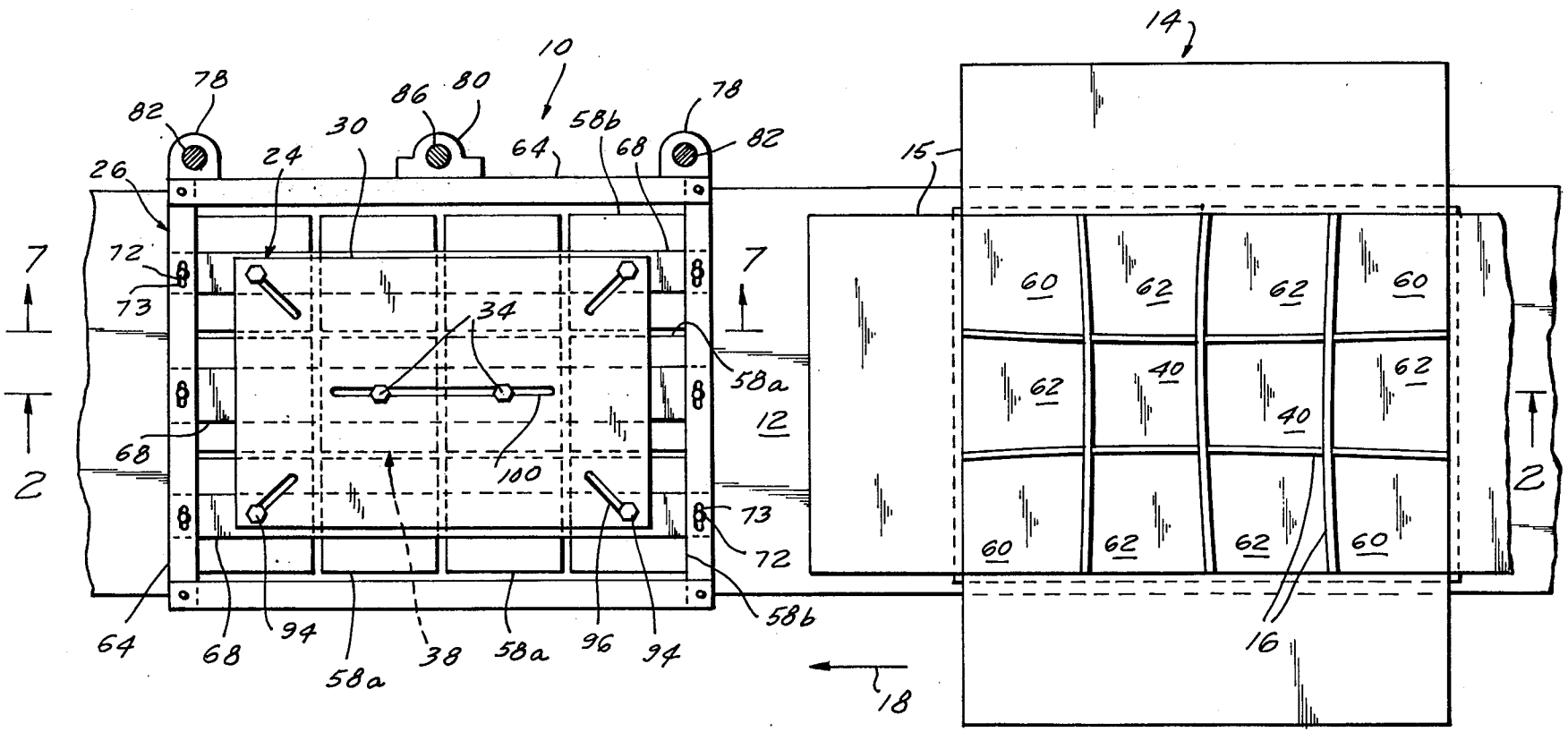
FIG. 1 is a fragmentary top plan view of a partition positioner according to the present invention, the partition positioner being disposed over a conveyor belt carrying a carton with partitions therein ready for straightening.
Figure 2:
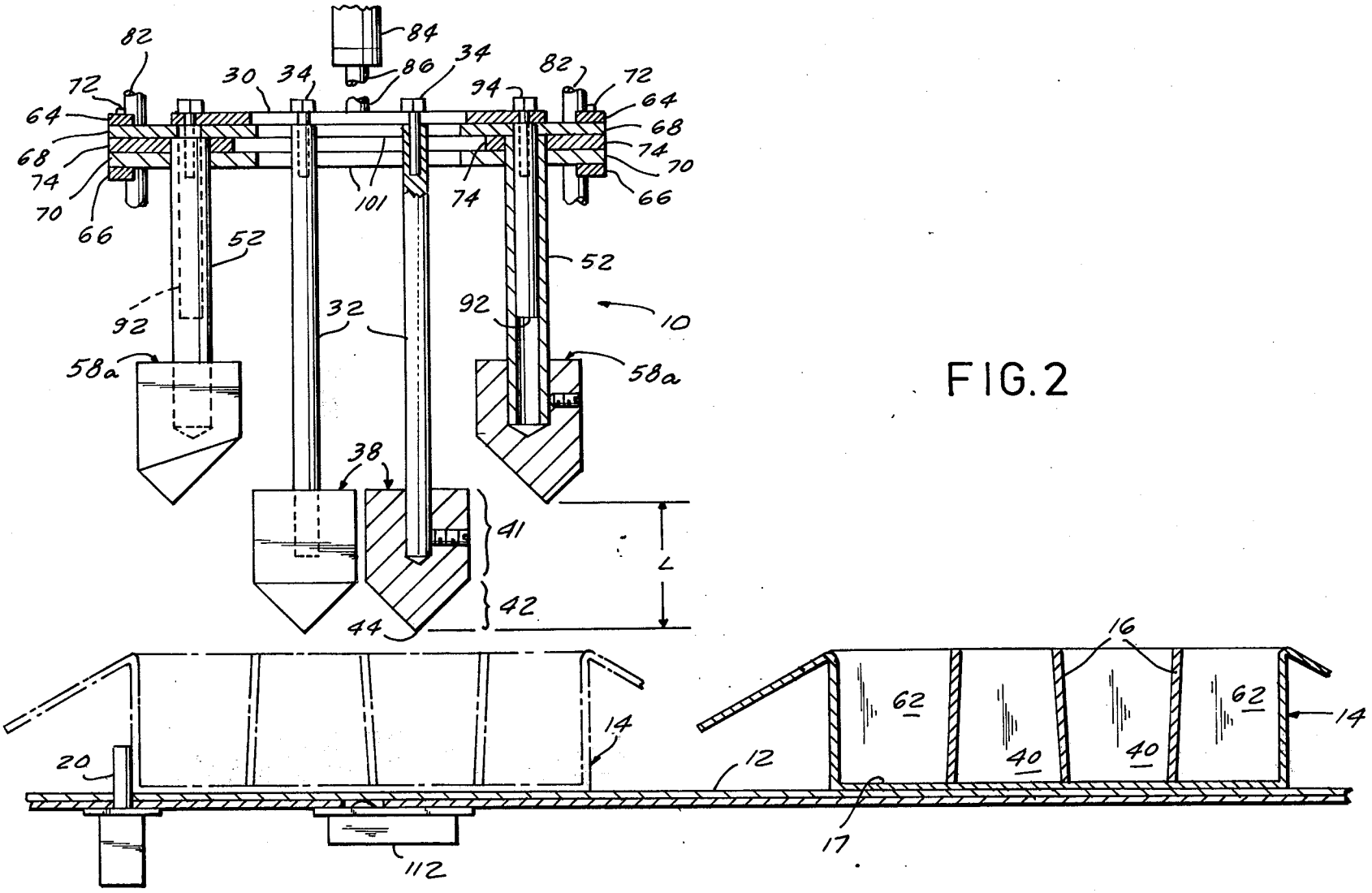
FIG. 2 is a fragmentary side elevation view, partially in cross-section, taken along the line 2—2 of FIG. 1 showing the inner mandrel set about to enter the inner compartments.

Referring now to the drawing, and in particular to FIGS. 1 and 2 thereof, therein illustrated is a partition positioner, generally designated 10, according to the present invention. The partition positioner 10 is disposed above a conventional conveyor belt 12 on which is disposed container 14, such as a paperboard carton having its top flaps 15 thereof open and a grid work of unstraightened partitions 16 disposed therein atop carton bottom 17. The conveyor 12 carries the carton 14 in the direction of arrow 18 until it is positioned directly underneath the partitioner positioner 10 as indicated in phantom line in FIG. 2. At this point either the conveyor 12 stops or an adjustable stop 20 operatively connected to the conveyor 12 is actuated to hold the carbon 14 in position while the conveyor 12 continues to travel.

The partition positioner 10 comprises a pair of assemblies, an inner assembly generally designated 24 and an outer assembly generally designated 26. The inner assembly 24 is comprised of a generally planar support means 30, such as a plate or sheet of metal, and a plurality of mandrels 32. Each mandrel 32 is secured to the support means 30 for vertical movement therewith (for example, by a bolt 34), extends generally transversely to the support means 30 towards the container bottom 17, and terminates adjacent container bottom 17 in a head, generally designated 38, adapted to align and straighten the partitions 16 defining an inner compartment 40 of the container.

For the 3 × 4 container 14 illustrated, there are two inner compartments 40 and hence two mandrels 32 connected to support 30 by bolts 34. The mandrel heads 38 have an upper portion 41 configured and dimensioned to closely approximate the inner dimensions of the inner compartment 40 and a lower portion 42 which tapers inwardly and downwardly to a point 44, the sloping surfaces of the bottom portion 42 being adapted to initially align and straighten the partitions 16 and the upper portion 41 being adapted to complete the aligning and straightening process. The mandrel heads 38 are secured to the lower portion of the associated mandrels 32 by means of set screws 46, although other securing means may be employed in place of set screws 46, and, if desired, each associated mandrel 32 and mandrel head 38 may be of one piece integral construction.

The outer assembly 26 comprises a generally planar support means, generally designated 50, and a plurality of mandrels 52. Each mandrel 52 is secured to the support means 50, extends generally transversely to the support means 50 towards the container bottom 17, and terminates adjacent the container bottom 17 in a head generally designated 58 and adapted to align and straighten the partitions 16 forming an outer compartment — namely, a corner compartment 60 or a side/end compartment 62. For the 3 × 4 container illustrated, there are four corner compartments 60 and six side/end compartments 62. The construction of outer mandrel heads 58 and their connection to outer mandrels 52 are generally similar to the construction of inner mandrel heads 38 and their attachment to inner mandrels 32 except as explained hereinafter.

Figure 5:
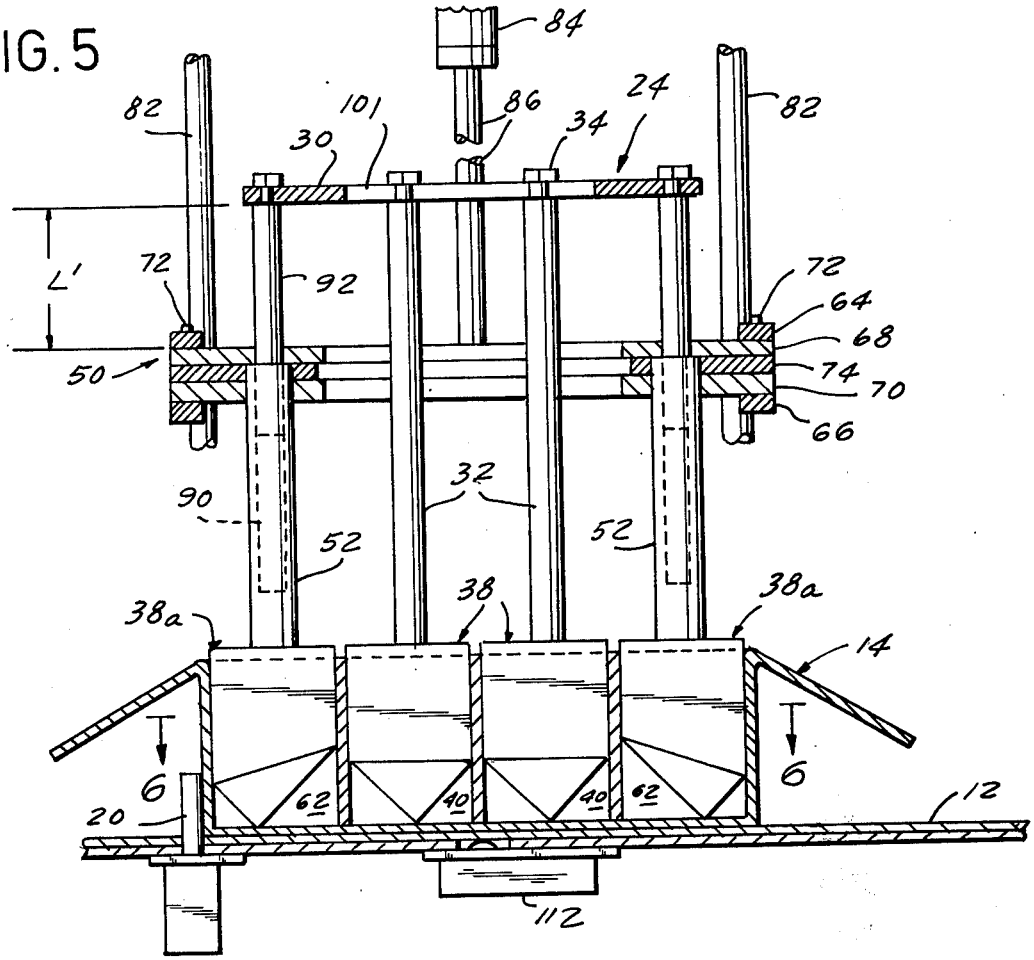
FIG. 5 is a fragmentary side elevation view, partially in cross-section, similar to FIG. 3, but showing the inner and outer mandrels all contacting the container bottom.

Referring now in particular to FIGS. 1, 2 and 5, the outer assembly support means 50 comprises a vertically spaced pair of rigid rectangular frames (a top frame 64 and a bottom frame 66) and a plurality of parallel, vertically spaced pairs of clamp members (each pair consisting of an upper clamp member 68 and a lower clamp member 70), the clamp members 68, 70 being disposed within planes intermediate the planes of the frames 64, 66 extending from one frame end to the other. The frame ends and clamp bar ends are secured together by bolts 72 passing therethrough, the frame ends being provided with horizontally extending slots 73 through which the bolts 72 pass, the slots 73 extending parallel to the axis of the frame end so that the bolts 72 at either end of a clamp member pair 68, 70 may be loosened to enable a limited side to side movement of the clamp member pair 68, 70 relative to the frame pair 64, 66. The tops of the outer mandrels 52 pass through suitably provided apertures in the lower clamp members 70 and are provided with horizontally extending flanges 74 trapped between the upper and lower clamp members 68, 70, so that the side to side movement of a clamp member pair 68, 70 effects a like movement of the associated outer mandrels 52.

On one side of the frames 64, 66 there are provided a pair of vertically apertured outer ears 78 and an intermediate ear 80. A separate vertically extending guide rod 82 extends through the aperture of each outer ear 78 to insure maintenance of the frames 64, 66 in a horizontal plane. Intermediate ear 80 is operatively secured to drive means for vertically moving the frame members 64, 66 of the outer assembly 26; for example, by means of a pneumatic cylinder 84 physically secured to the intermediate ear 80 by a piston 86. Alternate means for raising and lowering the frames 64, 66 may be provided. For example, the intermediate ear may be internally threaded and threadedly engaged by a rotatable vertically extending worm, rotation of the worm in one direction being effective to raise the frames and rotation of the worm in the other direction being effective to lower the frames.

Turning now to the connection between the first and second assemblies 24, 26, while the inner mandrels 32 may be solid, the outer mandrels 52 in the corners are partially hollowed to define cavities 90 open at the top thereof. A plurality of vertically extending aligning rods 92 (see FIG. 5) are provided for such outer mandrels 52, the bottom portion of each rod 92 being disposed within an outer mandrel cavity 90, an intermediate portion of each rod 92 passing through a suitably provided aperture in an associated upper clamp member 68, and the top portion of each rod 92 being secured to the inner mandrel support means 30 by means of a bolt 94. Thus the inner mandrel support means 30 normally or initially rests atop the upper clamp members 68 (as shown in FIGS. 2–3) and is capable of being raised thereabove (as shown in FIG. 5), with the aligning rods 92 serving to maintain the inner mandrel support means 30 in a plane parallel to the frames 64, 66 and hence the entire outer assembly support means 50.

To enable the inner mandrel support means 30 to accommodate the aligning rods 92, without regard to the side to side positioning of the clamp member pairs 68, 70 (and hence the outer mandrels 52), the aligning rods 92 are capable of assuming a variety of different positions along a diagonal slot 96 provided in each corner thereof. Similarly, in order to enable the inner mandrel support means 30 to accommodate various positionings of the inner mandrels 32, the inner mandrel support means 30 is provided with an axially extending slot 100, both inner mandrels 32 being adjustable in position along the slot 100 by loosening of the bolts 34 and retightening thereof once the mandrels 32 are in the desired position. Of course, for this purpose, the clamp member pair 68, 70 disposed directly underneath the slot 100 must also be provided with similar slots 101 as the inner mandrels 32 necessarily pass through the clamp member pair 68, 70.

Referring now to FIGS. 1 and 2, as the carton 14 is being transported to a position directly underneath the partition positioner 10, both assemblies 24, 26 are in the withdrawn position. Cylinder 84, acting through piston 86, maintains the frames 64, 66 and hence the clamp member pairs 68, 70 and outer mandrels 52 in a retracted or elevated position. The inner mandrels 32 are also maintained in a retracted or elevated position due to the fact that the inner assembly support means 30 is resting atop the upper clamp member 68 of the outer assembly 26. The inner mandrel heads 38 extend vertically towards the container 14 (and hence the container bottom 17) a distance L further than the outer mandrel heads 58, preferably by about the height of the inner mandrel heads 38.

Figure 3:
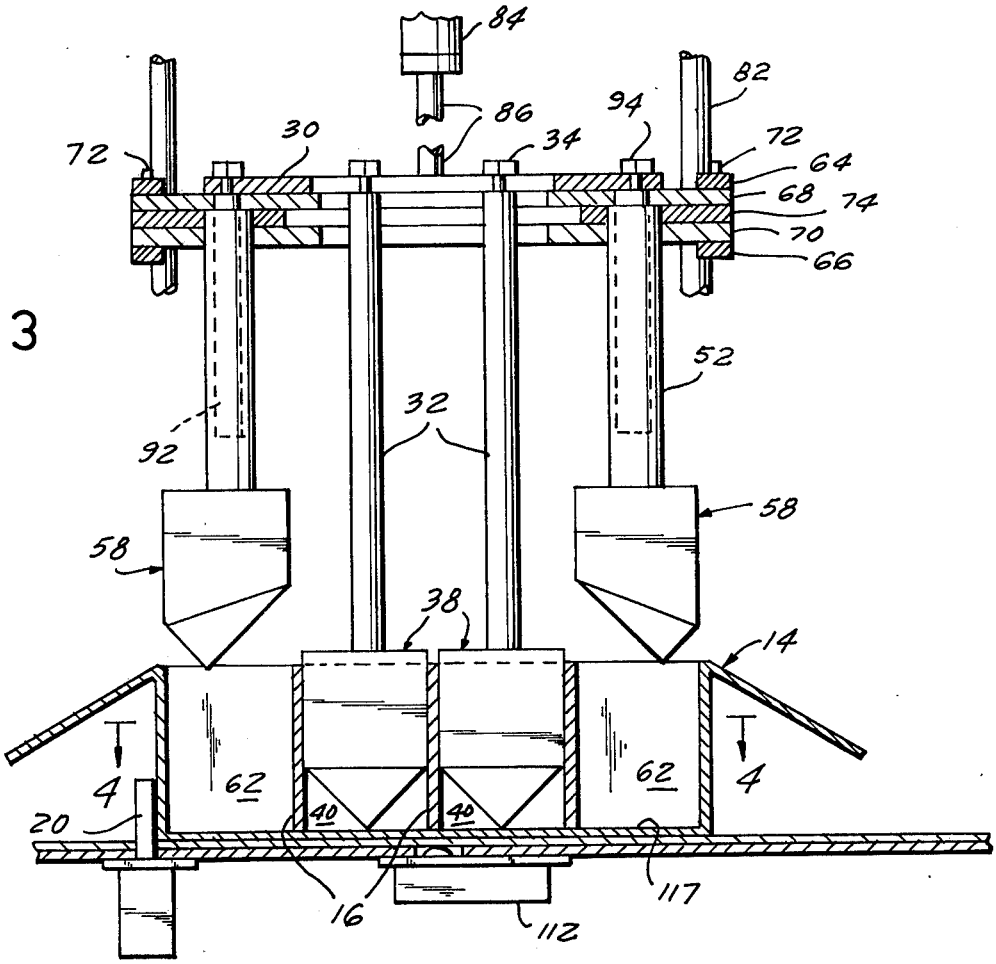
FIG. 3 is a fragmentary side elevation view, partially in cross-section, similar to FIG. 2 but showing the inner mandrels contacting the container bottom.
Figure 4:
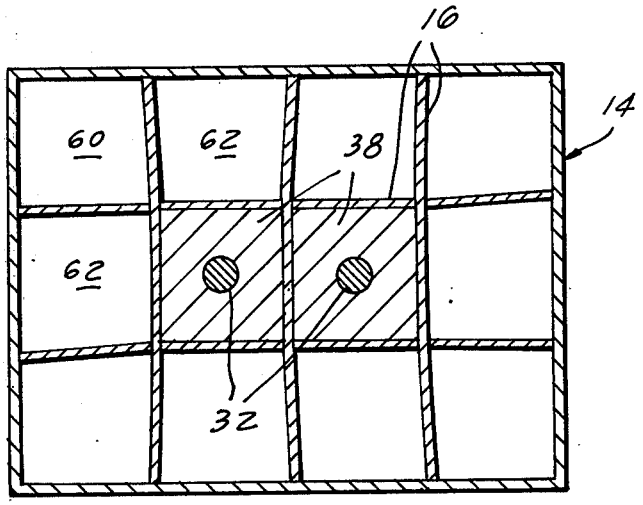
FIG. 4 is a top plan view, partially in cross-section, taken along the line 4—4 of FIG. 3.

Referring now to FIGS. 3 and 4, the cylinder 84 has lowered the frames 64, 66 a distance sufficient to cause the inner mandrels heads 38 to enter the center compartments 40 of the carton 14 and contact the carton bottom 17, with the outer mandrels heads 58 being just about to enter the outer compartments 60, 62. The presence of the inner mandrels heads 38 within the compartments 40 serves to straighten and align the partitions 16 defining the inner compartments 40 and to begin a partial straightening and alignment of the partitions defining the outer compartments 60, 62.

Figure 6:
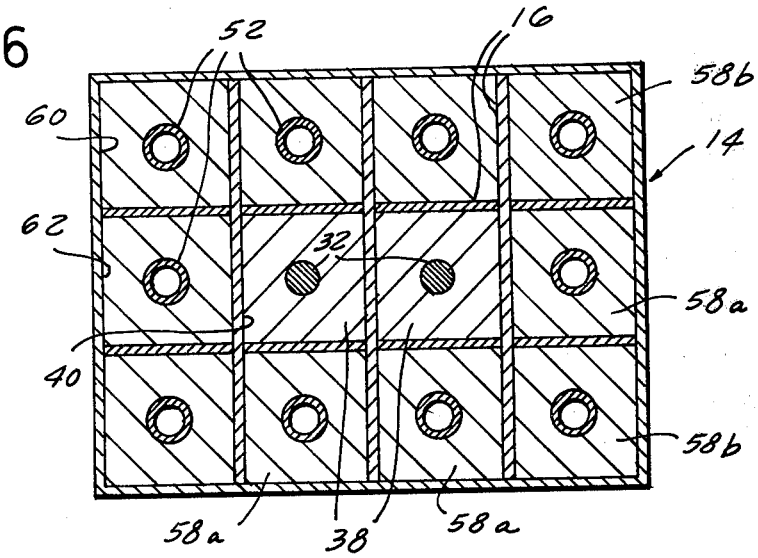
FIG. 6 is a top plan view, partially in cross-section, taken along the line 6—6 of FIG. 5.

Referring now to FIGS. 5 and 6, the cylinder 84 has lowered the frames 64, 66 a further distance L, so that the outer mandrels heads 58 are disposed within the outer compartments 60, 62 and touching the container bottom 17, thereby completing the straightening and aligning of the partitions 16 forming the outer compartments 60, 62. During this last movement the inner mandrels heads 38 have been precluded from further downward movement by virtue of the abutment of their points 44 against the container bottom 17. Inner assembly support means 30 is now vertically spaced above the upper clamp members 68 by a distance L' equal to the distance L (FIG. 2) initially separating the points 44 of the inner and outer mandrels 32, 52 prior to the contact of either with the container bottom 17 (that is, by their normal vertical separation). At this point all of the partitions 16 have been straightened and aligned so that the center, corner and side/end compartments 40, 60 and 62 are all properly defined. Accordingly, cylinder 84 is actuated in the opposite direction to cause retraction of the frames 64, 66. As the frames 64, 66 retract, they withdraw the outer mandrels heads 58 from the container 14, leaving the inner mandrels heads 38 disposed within the inner compartments 40. (See FIG. 3). Continued retraction of the frames 64, 66, after the point at which the upper clamp member 68 contacts the inner mandrel support means 30, causes the latter to be retracted with the frames 64, 66 until the inner mandrel heads 38 are disposed above the top of the container 14 (See FIG. 2). At this point the stop 20 is lowered, the carton 14 is carried away by the conveyor 12, and a new carton with unstraightened partitions 16 is brought into position under the partition positioner 10.

Because it will occasionally happen that a carton 14 being fed to the partition positioner 10 will arrive with one or more of the upper flaps 15 thereof in a closed position (that is, with the flaps 15 positioned over the top of the carton rather than outwardly over the sides thereof), it is desirable to position a pressure sensor 112 immediately below the conveyor belt 12. The pressure sensor 112 is preferably in the form of a limit switch which is not triggered by the slight downward pressure exerted by the mandrel heads against the container bottom 17, but is triggered only by the much larger downward force applied to the container 14, and hence the conveyor 12, when the cylinder 84 is driving the heads of a mandrel 32, 52 against a closed flap 15. The pressure sensor 112 is operatively connected to the cylinder 84 so that when the pressure sensor 112 is triggered, the cylinder 84 is returned to its initial position, thereby withdrawing the mandrel heads from the top of the container 14. Triggering of pressure sensor 112 also actuates a signal device (not shown) indicating that the flaps 15 should be manually opened and the partition positioning operation recommenced.

In a preferred embodiment of the present invention, three different types of mandrel heads are employed. Referring now in particular to FIGS. 2, 7 and 8, the bottom point 44 of each inner mandrels heads 38 is centered relative to the upper head portion 41 so that the point 44 impacts the center of the inner compartment 40. The heads 58 of the outer mandrels 52 are of two different types: the head 58*a* of each mandrel 52*a* adapted to enter a side/end compartment 62 is provided with a point 44*a* which is disposed appreciably off-center of the upper portion 41 of the head and closer to the outer side or end of the compartment 62 (that is, offset towards the closest periphery of the container 14), and the head 58*b* of each mandrel 52*b* adapted to enter a corner compartment 60 is provided with a point 44*b* which is disposed appreciably off-center of the upper portion 41 of the head and closer to the adjacent coerner of the container 14. In other words, a vertical axis through the point 44*a* of a side/end mandrel 52*a* is offset in one X or Y axis direction from the shaft of the mandrel towards a side/end of the mandrel head upper portion 41, while a vertical axis through the point 44*b* of a corner mandrel 52*b* is offset in both the X and Y axis directions towards a corner of the mandrel head upper portion 41 (that is, along a diagonal). As the walls of the carton 14 are the equivalent of an already straightened partition 16, the off-center placement of the points 44*a*, 44*b* of the side/end and corner mandrels 52*a*, 52*b*, respectively towards such carton walls insures that the heads 58*a*, 58*b*, repsectively, will be able to enter the side/end and corner compartments 62, 60, respectively, even through the other walls of such compartments (defined by actual partitions 16) remain slightly collapsed after proper positioning of the inner compartments 40.

The principles of the present invention are applicable not only to containers of 3 × 4 size, as shown and described, but also to any container of at least 3 × 3 size. It will be appreciated that in all cases the mandrels of the outer assembly 26 are only those whose heads 58 contact the periphery (i.e. the sides and ends and corners) of the container 14, while all other mandrels are part of the inner assembly 24. To accommodate containers having compartments of larger or smaller size, the removable mandrel heads 38, 58 may be replaced by mandrel heads appropriate in dimensions to the compartment in question, the side-to-side spacing of the mandrels being adjustable as described hereinabove by movement of the cross members 68, 70 and the end-to-end spacing being adjustable by sliding the mandrels back and forth along the axis of the cross members. The number, orientation, spacing and size of slots 96 and 100 in the inner assembly support means 30 and of slots 101 in the cross members 68, 70 will, of course, be a function of the lay-out and size of the carton compartments and the degree of flexibility desired in meeting the needs of various container layouts and sizes.

To summarize, the present invention provides a partition positioner utilizing a pair of mandrel assemblies secured together in a floating manner enabling relative movement between the assemblies so that full depth thrusting of the mandrels in a sequential fashion (inner mandrels first, outer mandrels last) is obtainable utilizing only a single driving means.

Now that the preferred embodiments of the present invention have been shown and described, various modifications and improvements thereon will become readily apparent to those skilled in the art. For example, while the foregoing specification is directed to apparatus in which the mandrels are arranged in a pattern related to and corresponding to the pattern of compartments to be formed by the partitions in the container, the principles disclosed therein are equally applicable to apparatus in which the mandrels are arranged in a pattern related to but not corresponding to the pattern of compartments; for example, apparatus in which the mandrels are arranged in the pattern disclosed in the commonly assigned U.S. patent application Ser. No. 856,610, filed on even date herewith in the name of John Wiseman. Accordingly, the spirit and scope of the present invention to be limited only by the appended claims, and not by the foregoing specification.

I claim:

1. Apparatus for positioning partitions in a container to form compartments to receive articles comprising:

A. first and second assemblies, each of said assemblies comprising support means and at least one mandrel secured to said support means, extending therefrom in a given direction towards the container bottom, and terminating in a head adapted to align and straighten the partitions in the container to form compartments for the receipt of articles;

B. means for securing said first assembly to said second assembly in a manner permitting relative motion therebetween between first and second relative positions, the mandrels of said first assembly extending in said given direction for a given direction beyond the mandrels of said second assembly when said assemblies are in said first relative position, movement of said assemblies to said second relative position resulting in a lessening of said given distance, said mandrels collectively being arranged in a pattern related to a desired compartment pattern in the container; and C. means for moving said first and second assemblies in said given direction and permitting said relative movement therebetween.

2. The apparatus of claim 1 wherein said mandrels of said first assembly are located more centrally of said pattern than said mandrels of said second assembly.

3. The apparatus of claim 2, wherein, when said assemblies are in said second relative position, said given distance is essentially zero.

4. The apparatus of claim 1 wherein, when said assemblies are in said second relative position, said given distance is essentially zero.

5. The apparatus of claim 3 wherein, in one of said assemblies, the mandrel or mandrels associated therewith are mounted on said support means adjustably in a direction substantially at right angles to said given direction.

6. The apparatus of claim 2 wherein, in one of said assemblies, the mandrel or mandrels associated therewith are mounted on said support means adjustably in a direction substantially at right angles to said given direction.

7. The apparatus of claim 1 wherein, in one of said assemblies, the mandrel or mandrels associated therewith are mounted on said support means adjustably in a direction substantially at right angles to said given direction.

8. The apparatus of claim 1 wherein said first assembly support means is disposed above and normally supported by said second assembly support means.

9. The apparatus of claim 8 wherein, when said assemblies are in said second relative position, said given distance is essentially zero.

10. The apparatus of claim 8 wherein said mandrels of said first assembly are located more centrally of said pattern than said mandrels of said second assembly.

11. The apparatus of claim 10 wherein, when said assemblies are in said second relative position, said given distance is essentially zero.

12. The apparatus of claim 1 wherein said first assembly mandrel heads have points at the bottom thereof, said points being aligned with the centers of the compartments to be formed by said partitions after alignment and straightening thereof.

13. The apparatus of claim 12 wherein said second assembly mandrel heads have points at the bottom thereof, at least some of said points being offset from the centers of the compartments to be formed by said partitions after alignment and straightening thereof in the direction of the walls of the container.

14. The apparatus of claim 1 wherein each of said first assembly mandrel heads terminates in a point centered relative to said first assembly mandrel head.

15. The apparatus of claim 1 wherein at least some of said second assembly mandrel heads terminate in points off-center relative to said second assembly mandrel heads.

16. The apparatus of claim 1 wherein some of said second assembly mandrels are hollow and said securing means includes guide rods depending from said first assembly support means and slidably received in said second assembly mandrels.

17. The apparatus of claim 1 additionally including limit switch means operatively disposed on the surface of the container bottom opposite that contacted by said mandrel heads to detect and respond to the presence of a misplaced flap of the container by terminating movement of at least one of said assemblies in said given direction.

18. Apparatus for positioning the partitions in a container to receive articles comprising:

A. first and second support means;

B. first and second sets of mandrels secured to said first and second support means and extending therefrom in a given direction respectively;

C. means for operably connecting said first support means and said second support means for limited relative movement therebetween between an initial position wherein said first mandrel set extends further in a given direction towards the bottom of the container than said second mandrel set and a second position wherein both said mandrel sets extend substantially equal distances in said given direction; and D. means for moving said second support means towards the container bottom, such that said first mandrel set engages the partition with said support means in said initial position, and, thereafter, said second mandrel set engages the partition; said support connecting means enabling said support means to assume said second position after said first mandrel set engages the container bottom and said moving means continues to move said second support means towards the container bottom.

* * * * *